United States Patent [19]

Takasugi

[11] Patent Number: 4,989,269

[45] Date of Patent: Feb. 5, 1991

[54] SHIRT COLLAR

[76] Inventor: Hiroshi Takasugi, 62-19, Aza Mukaihara,, Ooaza Sakasagawa, Tanagura-machi, Higashishirakawa-gun, Fukushima-ken, Japan

[21] Appl. No.: 429,407

[22] Filed: Oct. 31, 1989

[30] Foreign Application Priority Data

May 17, 1989 [JP] Japan ..... 1-56912

[51] Int. Cl.[5] ..... A41B 3/00; A41B 3/18

[52] U.S. Cl. ..... 2/116; 2/131; 2/132; 2/139

[58] Field of Search ..... 2/129, 132, 131, 133, 2/134, 135, 136, 138, 139, 140, 141 R, 141 A, 142, 143, 116, 60

[56] References Cited

U.S. PATENT DOCUMENTS

| | | | |
|---|---|---|---|
| 422,054 | 2/1890 | Keller | 2/116 |
| 851,268 | 4/1907 | Way | 2/60 |
| 1,235,454 | 7/1917 | Finkelstein | 2/132 |
| 1,243,463 | 10/1917 | Turrell | 2/132 X |
| 1,364,608 | 1/1921 | Becker | 2/132 X |
| 1,388,056 | 8/1921 | North | 2/60 |
| 2,182,582 | 12/1939 | Cohen | 2/60 |
| 2,514,646 | 7/1950 | Johnson | 2/60 |
| 2,634,420 | 4/1953 | Jackson | 2/60 |
| 3,088,117 | 5/1963 | Baker | 2/132 X |
| 3,860,967 | 1/1975 | Tedesco | 2/129 |
| 4,008,494 | 2/1977 | Hicks | 2/60 |
| 4,603,440 | 8/1986 | Hale | 2/116 |
| 4,653,119 | 3/1987 | Kaiser | 2/60 |

FOREIGN PATENT DOCUMENTS

| | | | |
|---|---|---|---|
| 1222354 | 6/1987 | Canada | 2/60 |
| 1381619 | 11/1964 | France | 2/129 |
| 27572 | 12/1908 | United Kingdom | 2/60 |
| 848554 | 9/1960 | United Kingdom | 2/139 |

*Primary Examiner*—Werner H. Schroeder
*Assistant Examiner*—Jeanette E. Chapman
*Attorney, Agent, or Firm*—Darby & Darby

[57] ABSTRACT

In shirt collars having neckbands, an improved shirt collar comprises more than one soft layer disposed on the inside of the neckband, each soft layer being arcuately smaller than the neckband and a space exists between a pair of soft layers. Thereby, the soft layer reduces pressure on the neck of the wearer and gives the neckband durability. A tendency for the soft layer to bunch up and wrinkle is substantially reduced by the presence of the space between layers.

15 Claims, 1 Drawing Sheet

SHIRT COLLAR

BACKGROUND OF THE INVENTION

1. Field of the Invention

The field of the invention relates to an improved shirt collar having a soft layer on the inside of a neckband thereof.

2. Prior Art

Heretofore, neckbands of shirt collars, especially for men, have been made of exceedingly hard materials and therefore have been very uncomfortable. Such shirt collars provide no means for lessening pressure on the back of the neck, larynx, blood vessels, and other areas where the constricting collar is uncomfortable. Furthermore, by the nature of the materials, sweat is not absorbed in warm weather and heat is not retained in cold weather.

In addition, neckbands of shirt collars are easy to get dirty and lacking durable properties.

SUMMARY OF THE INVENTION

Accordingly, an object of the present invention is to solve the above problems and to provide an improved shirt collar having a soft layer on a neckband thereof.

In order to achieve the above object, the present invention provides an improved shirt collar comprising a neckband and at least one soft layer disposed on the inside of the neckband, the at least one soft layer being smaller than the neckband, whereby the soft layer reduces pressure on the neck of a wearer and gives the shirt collar durability.

DETAILED DESCRIPTION OF PREFERRED EMBODIMENTS

Figure 1:
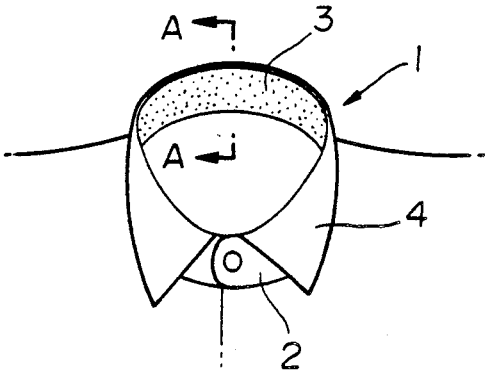
FIG. 1 is a perspective view of an improved shirt collar according to an embodiment of this invention.
Figure 2:
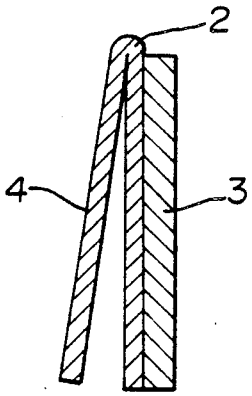
FIG. 2 is a vertical cross-sectional view of the shirt collar cut along the arrows A—A shown in FIG. 1.
Figure 3:
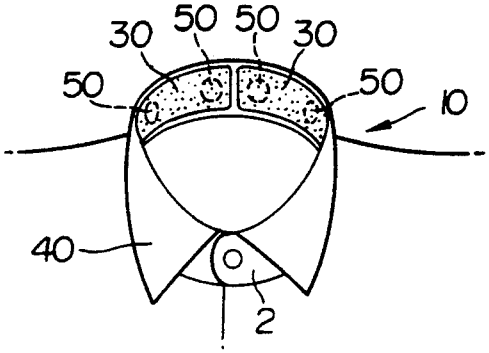
FIG. 3 is a perspective view of an improved shirt collar according to a second embodiment of this invention.

Referring to FIGS. 1 and 2, an improved shirt collar according to an embodiment of the present invention is explained. In the figures, a shirt collar 1 comprises a neckband 2, a soft layer 3 having generally a little smaller size than the neckband 2, and an external collar 4. In the present embodiment, the soft layer 3 is sewn to the inside of the neckband 2 to be in contact with the wearer's neck. In order to reduce pressure on the neck of the wearer, the soft layer 3 is composed of soft material such as cotton flannel, velvet, toweling, quilted material, or the like. Furthermore, by nature of the material of the soft layer 3, sweat is absorbed and ventilation is excellent in warm weather and heat is retained in cold weather. By fixing the soft layer 3 to the neckband 2, the shirt collar 1 has durability.

Next, an improved shirt collar according to a second embodiment of the present invention is explained. A shirt collar 10 comprises a neckband 2, two soft layers 30 composed of the same material described in the previous embodiment, and an external collar 40. A difference between the two embodiments is the space that separates the two layers 30 at the back of the neck band 2. Each layer 30 has an arcuate length that is less than half of the arcuate length of the neck band and is so positioned on the neck band 2 as to provide the space between the layers 30. Another difference between the previous embodiment and the second embodiment is that each soft layer 30 is detachably connected to the inside of the neckband 20 by connection means 50 in the second embodiment. As connection means 50, hook and eye, snaps, hook and loop tape, buttons and holes, or the like are used. The detachable soft layers 30 can be applied to the conventional shirt, so that each detachable soft layer 30 is disposable or washable when getting dirty and size of the neckband is adjusted by using the detachable soft layer.

The above description represents the preferred embodiments of the present invention. Many variations of the embodiments are possible, including but not limited to providing an improved shirt collar having at least one soft layer of various number and size as long as it retains its function. The material of the soft layer may be selected from fashionable pattern textiles: ventilated material, and the like.

What is claimed is:

1. In shirt collars having neckbands of arcuate length to encircle at least partially the wearer's neck, an improved shirt collar comprises more than one soft layer disposed on the inside of the neckband, each soft layer being arcuately shorter than the neckband length, at least a pair of said layers having an arcuate space therebetween, whereby the soft layers reduce pressure on the neck of a wearer and give the shirt collar durability.

2. An improved shirt collar according to claim 1, wherein the improved shirt collar further comprising connection means for detachably connecting the soft layers 5 with the inside of the neckband.

3. An improved shirt collar according to claim 1, wherein the soft material is cotton flannel.

4. An improved shirt collar according to claim 1, wherein the soft material is velvet.

5. An improved shirt collar according to claim 1, wherein the soft layer is composed of a material that is at least one of absorbant and insulating, whereby sweat is absorbed in warm weather and heat is retained in cold weather.

6. An improved shirt collar according to claim 5, wherein the material is toweling.

7. An improved shirt collar according to claim 5 wherein the material is quilted material.

8. An improved shirt collar according to claim 2, wherein the soft material is cotton flannel.

9. An improved shirt collar according to claim 2, wherein the soft material is velvet.

10. An improved shirt collar according to claim 2, wherein the soft layer is composed of a material that is at least one of absorbant and insulating material, whereby sweat is absorbed in warm weather and heat is retained in cold weather.

11. An improved shirt collar according to claim 10, wherein the material is toweling.

12. An improved shirt collar according to claim 10 wherein the material is quilted material.

13. An improved shirt collar as in claim 1, wherein each said soft layer is less than one half the arcuate length of said neckband.

14. An improved shirt collar as in claim 1, wherein said soft layers are detachably attached to said neckband by hook and loop tapes attached to said soft layers and said neckband.

15. An improved shirt collar as in claim 13 wherein the number of said soft layers is two.

* * * * *